US006004230A

United States Patent [19]

Hooker

[11] Patent Number: 6,004,230

[45] Date of Patent: Dec. 21, 1999

[54] METHODS FOR TRAINING GOLF PUTTING SKILLS

[75] Inventor: Jeffrey A. Hooker, Melbourne, Fla.

[73] Assignee: Intelligent Machine Concepts, LLC, New Orleans, La.

[21] Appl. No.: 09/128,209

[22] Filed: Aug. 3, 1998

Related U.S. Application Data

[62] Division of application No. 08/909,527, Aug. 12, 1997, Pat. No. 5,788,588.

[51] Int. Cl.[6] ..... A63B 69/36

[52] U.S. Cl. ..... 473/409; 473/220

[58] Field of Search ..... 473/220, 409

[56] References Cited

U.S. PATENT DOCUMENTS

| | | | |
|---|---|---|---|
| 5,207,429 | 5/1993 | Walmsley et al. | 473/220 |
| 5,388,831 | 2/1995 | Quadri et al. | 473/220 |
| 5,467,991 | 11/1995 | White | 473/220 |
| 5,788,588 | 8/1998 | Hooker | 473/220 X |
| 5,848,944 | 12/1998 | Brannen | 473/220 X |

*Primary Examiner*—George J. Marlo
*Attorney, Agent, or Firm*—Allen, Dyer, Doppelt, Milbrath & Gilchrist, P.A.

[57] ABSTRACT

A method of training golf putting skills is provided which is related to improving a sweet-spot type swing for a golfer. The method preferably includes determining a sweet spot of the head of a golf putting club, positioning a light projecting apparatus on a proximal end portion of a golf putting club, and downwardly projecting a beam of light from the apparatus positioned on the proximal end portion of the golf putting club onto a putting surface so as to form a line of light positioned substantially perpendicular to and extending outwardly a substantial distance prior to and a substantial distance away from the sweet spot of the head of the golf putting club. The method also preferably includes performing a pendulum-type swing on either a real or imaginary ball and attempting to maintain the line of light so that it passes over the center of the ball and remains there throughout the stroke until ball contact is made.

4 Claims, 8 Drawing Sheets

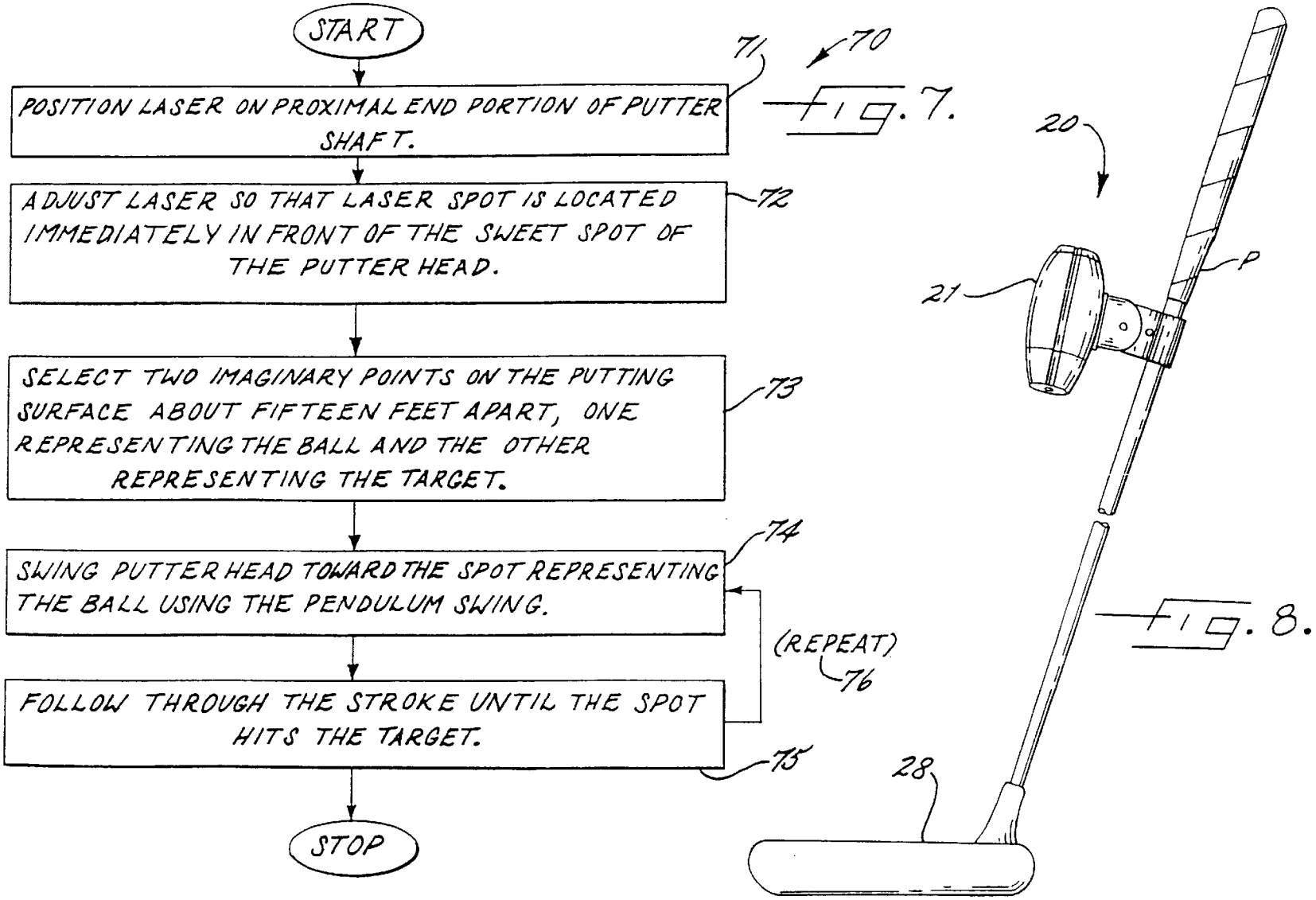
FIG. 8.
20
21
P
28
FIG. 7.
70
71
72
73
74
75
(REPEAT)
76
START
POSITION LASER ON PROXIMAL END PORTION OF PUTTER SHAFT.
ADJUST LASER SO THAT LASER SPOT IS LOCATED IMMEDIATELY IN FRONT OF THE SWEET SPOT OF THE PUTTER HEAD.
SELECT TWO IMAGINARY POINTS ON THE PUTTING SURFACE ABOUT FIFTEEN FEET APART, ONE REPRESENTING THE BALL AND THE OTHER REPRESENTING THE TARGET.
SWING PUTTER HEAD TOWARD THE SPOT REPRESENTING THE BALL USING THE PENDULUM SWING.
FOLLOW THROUGH THE STROKE UNTIL THE SPOT HITS THE TARGET.
STOP

METHODS FOR TRAINING GOLF PUTTING SKILLS

This application is a division of Ser. No. 08/909,527, filed Aug. 12, 1997, to issue as U.S. Pat. No. 5,788,588, on Aug. 4, 1998.

FIELD OF THE INVENTION

The present invention relates to the field of skill training and, more particularly, to golf putting skill training.

BACKGROUND OF THE INVENTION

The sport of golf has grown dramatically over the years in popularity, public interest, and commercial interest. Also, various golf training aids and practice systems have been developed for improving various golfer skills associated with playing golf. Some of these training aids include golf shot alignment systems which emit a laser beam from the face of the club for aligning a golf clubface with a target and for assisting with the direction of the swing toward the target. Examples of such systems can be seen in U.S. Pat. No. 5,482,283 by Wall titled "Golf Club," U.S. Pat. No. 5,193,812 by Hendricksen titled "Golf Club With Laser Alignment System," and U.S. Pat. No. 3,953,034 by Nelson titled "Laser Beam Golf Swing Training Device." These systems, however, are embedded in special club which can be expensive and difficult to manufacture. These systems also focus on aligning a club with a target and fail to assist or train a golfer in developing an effective and proper putting stroke.

Golf club aiming systems have also been developed which attach to golfer selected golf clubs. Examples of such systems can be seen in U.S. Pat. No. 5,207,429 by Walmsley et al. titled "Club Aiming Unit," U.S. Pat. No. 3,953,034 by Nelson titled "Laser Beam Golf Swing Training Device," and U.S. Pat. No. 3,070,373 by Mathews et al. titled "Visual Type Swing Indicator Attachment For Golf Clubs." These golf club aiming systems, however, fail to assist a putter in accomplishing various training exercises which enable a putter to be more effective. Instead, these prior systems focus on only one or two exercises in assisting golfer with aligning shots.

SUMMARY OF THE INVENTION

With the foregoing in mind, the present invention advantageously provides methods of improving putting skills for a golfer and an apparatus for training a golfer for putting skills needed to enhance a game of golf. The present invention also advantageously provides an apparatus which has a plurality of mounting and aligning positions to more effectively train a golfer on a variety of putting skills.

Therefore, these and other advantages, are provided by an apparatus for training a plurality of golf putting skills and being adapted to connect to a shaft of a golf putting club. The apparatus preferably includes a housing and an optical transmitter positioned in the housing for transmitting light therefrom. Light pattern configurating means is associated with the housing for selectively configuring the transmitted light into either a line pattern of light or a spot pattern of light. The apparatus also preferably includes shaft mounting means connected to the housing for adjustably and detachably connecting the housing to the shaft of a golf putting club.

The present invention also advantageously provides several methods of training golf putting skills. A method of training golf putting skills related to improving a pendulum-type swing for a golfer preferably includes positioning a light projecting apparatus on a golf putting club and projecting a beam of light from the apparatus onto a putting surface so as to form a line positioned transverse to the longitudinal direction of a golfer's feet and between the golfer's feet and the head of the golf putting club. A portion of the putting surface is selected as having an imaginary ball positioned thereon. A golfer then attempts to maintain the line of light generally parallel to a putting swing path and generally perpendicular to the longitudinal direction of the golfer's feet and performs a pendulum swing while observing the line of light.

A method of training golf putting skills related to improving a sweet-spot type swing for a golfer is also provided. The method preferably includes determining a sweet spot of the head of a golf putting club, positioning a light projecting apparatus on a golf putting club, and projecting a beam of light from the apparatus onto a putting surface so as to form a line positioned generally perpendicular to and outwardly from the sweet spot of the head of the golf putting club. A golfer then performs a pendulum swing on either a real or imaginary ball and attempts to maintain the line of light so that it passes over the center of the ball and remains there throughout the stroke until ball contact is made.

Additionally, a method of training golf putting skills related to reducing pulling and pushing tendencies in a putting pendulum-type swing for a golfer is provided. The method preferably includes positioning a light projecting apparatus on a golf putting club and projecting a beam of light from the apparatus onto a putting surface so as to form a spot positioned adjacent a sweet spot of the head of the golf putting club. Two imaginary points on the putting surface are selected a predesired distance apart. A first imaginary point preferably represents an imaginary ball and a second imaginary point preferably represents a target. A golfer preferably performs a pendulum swing on the imaginary ball using the golf putting club and follows through the putting stroke until the projected spot of light hits the target so that the golfer thereby attempts to draw a straight imaginary line from the ball to the target.

A method of training golf putting skills related to improving a follow-through in a putting pendulum-type swing for a golfer is further provided. The method preferably includes positioning a light projecting apparatus on a golf putting club and projecting a beam of light from the apparatus onto a putting surface so as to form a spot positioned adjacent a sweet spot of the head of the golf putting club. A golfer then performs a pendulum swing on a golf ball using the golf putting club and attempts to maintain the projected spot of light on the golf ball after striking the golf ball with the head of the golf putting club until it reaches the target.

The present invention also preferably includes one or more combination of the methods. A method of training golf putting skills according to an embodiment of such a combination preferably includes practicingly repeating a pendulum-type swing, using the practiced pendulum-type swing for practicingly repeating a sweet-spot type swing, and using the practiced pendulum-type and the practiced sweet-spot type swing for practicingly repeating a follow through during the practiced pendulum swing. The method can also include using the practiced pendulum-type swing for practicingly repeating a putting stroke so as to reduce tendencies to push or pull a golf putting club during the pendulum-type swing.

By the use of an apparatus of the present invention, a golfer can advantageously practice and train to have a more effective putting stroke by the use of the various methods of the invention. The apparatus allows a golfer to practice all of these methods of the invention either in isolation, in combination, or in series so that one of the skills learned from one method and once mastered can assist in performing the other training skills, e.g., practicing a pendulum-type swing assists with practicing follow through or practicing to reduce tendencies to push or pull the golf putting club.

BRIEF DESCRIPTION OF THE DRAWINGS

Some of the features, advantages, and benefits of the present invention having been stated, others will become apparent as the description proceeds when taken in conjunction with the accompanying drawings in which:

FIG. 7 is a schematic flow diagram of a method of training golf putting skills according to a third embodiment of the present invention;

FIG. 8 is a side elevational view of an apparatus for training golf putting skills mounted on the shaft of a golf putting club according to the present invention;

DETAILED DESCRIPTION

The present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art. Like numbers refer to like elements throughout.

Figures 1, 2:
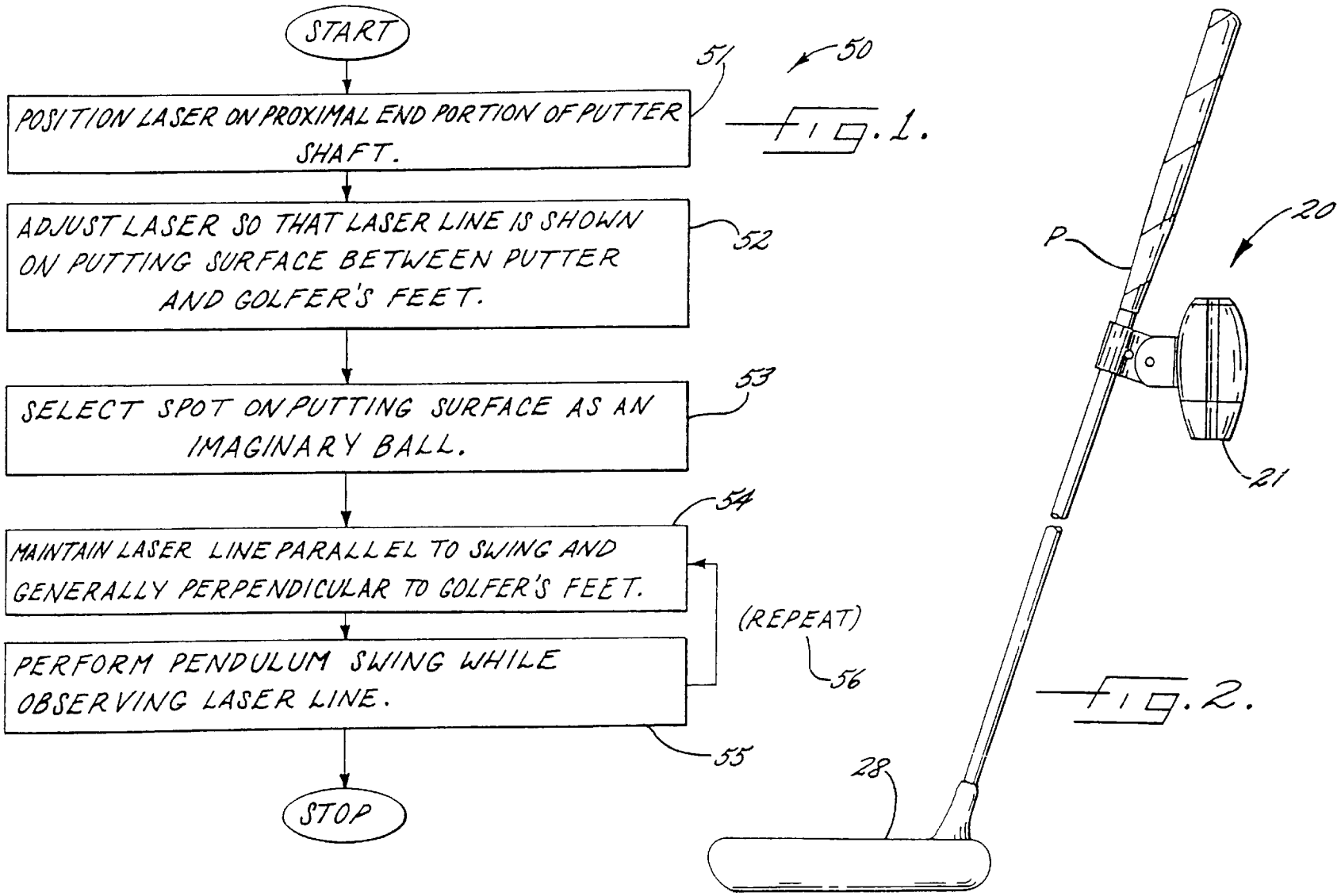
FIG. 1 is a schematic flow diagram of a method of training golf putting skills according to a first embodiment of the present invention.
FIG. 2 is a side elevational view of an apparatus for training golf putting skills mounted on the shaft of a golf putting club according to the present invention.
Figure 3:
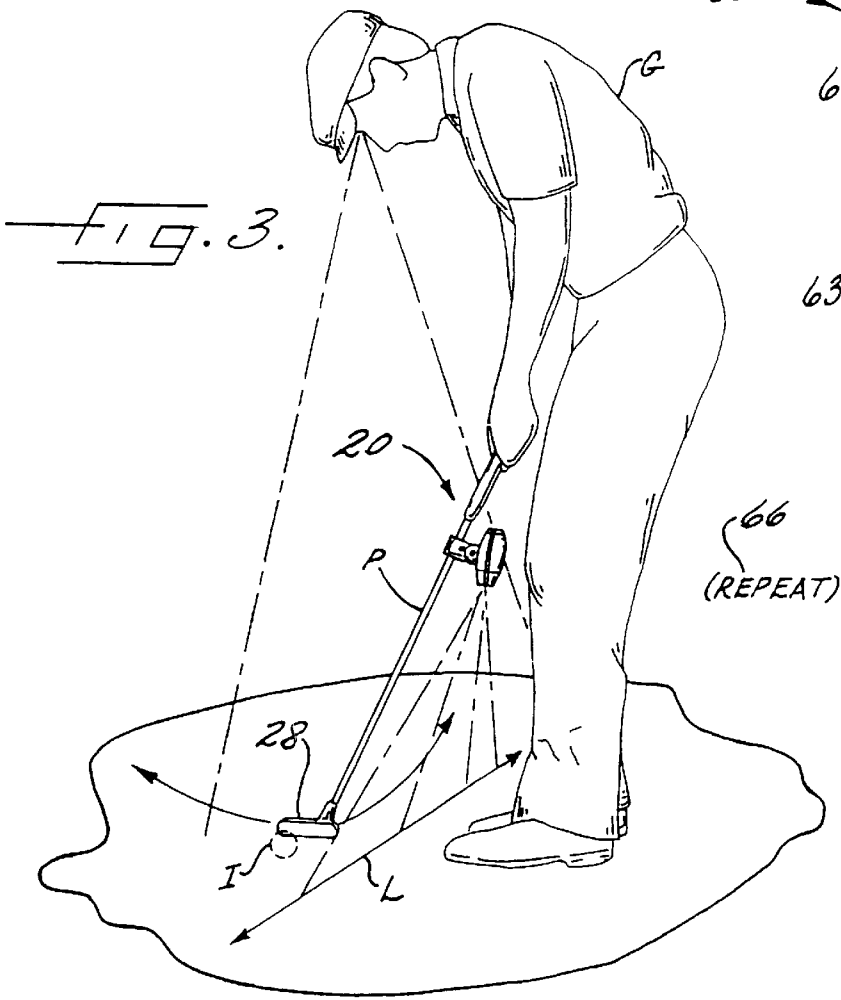
FIG. 3 is a perspective view of a golfer using an apparatus and a method according to a first embodiment of the present invention.

FIGS. 1–3 illustrate a method 50 of training golf putting skills related to improving a pendulum-type swing for a golfer according to the present invention. The method 50 preferably includes positioning 51 a light projecting apparatus 20 on a proximal end portion of a golf putting club P, e.g., a putter as understood by those skilled in the art, and projecting 52, e.g., including adjusting the light projecting apparatus 20, a beam of light from the apparatus 20 onto a putting surface so as to form a line L positioned transverse to the longitudinal direction of a golfer's feet and between the golfer's feet and the head 28 of the golf putting club P. A portion of the putting surface is preferably selected 53 as having an imaginary ball I positioned thereon. A golfer G then attempts to maintain 54 the line L of light generally parallel to a putting swing path and generally perpendicular to the longitudinal direction of the golfer's feet and performs 55 a pendulum swing while observing the line L of light.

The method 50 preferably also includes repeating 56 the steps of attempting to maintain 54 the line L of light and performing 55 a pendulum-type swing to thereby develop a proper and consistent pendulum-type putting stroke. The visual guidance from the light also enhances the memory of the golfer G in remembering the path of travel of the golf putting club P and the feel or movement of the putting club P when putting on a real green or golf course and not using the apparatus 20. The step of performing a pendulum-type swing 55, as understood by those skilled in the art, preferably includes simultaneously pivoting both arms of a golfer G about the shoulders of the golfer G in a clockwise direction to a desired elevation upwardly away from the imaginary ball I and then simultaneously pivoting both arms of the golfer G in a counter clockwise direction downwardly toward the imaginary ball. The step of positioning 51 a light projecting apparatus 20 preferably includes the apparatus 20 leaving a laser 26 positioned in a housing 21 and adapted to project light therefrom (see FIGS. 2 and 13–15).

Figure 4:
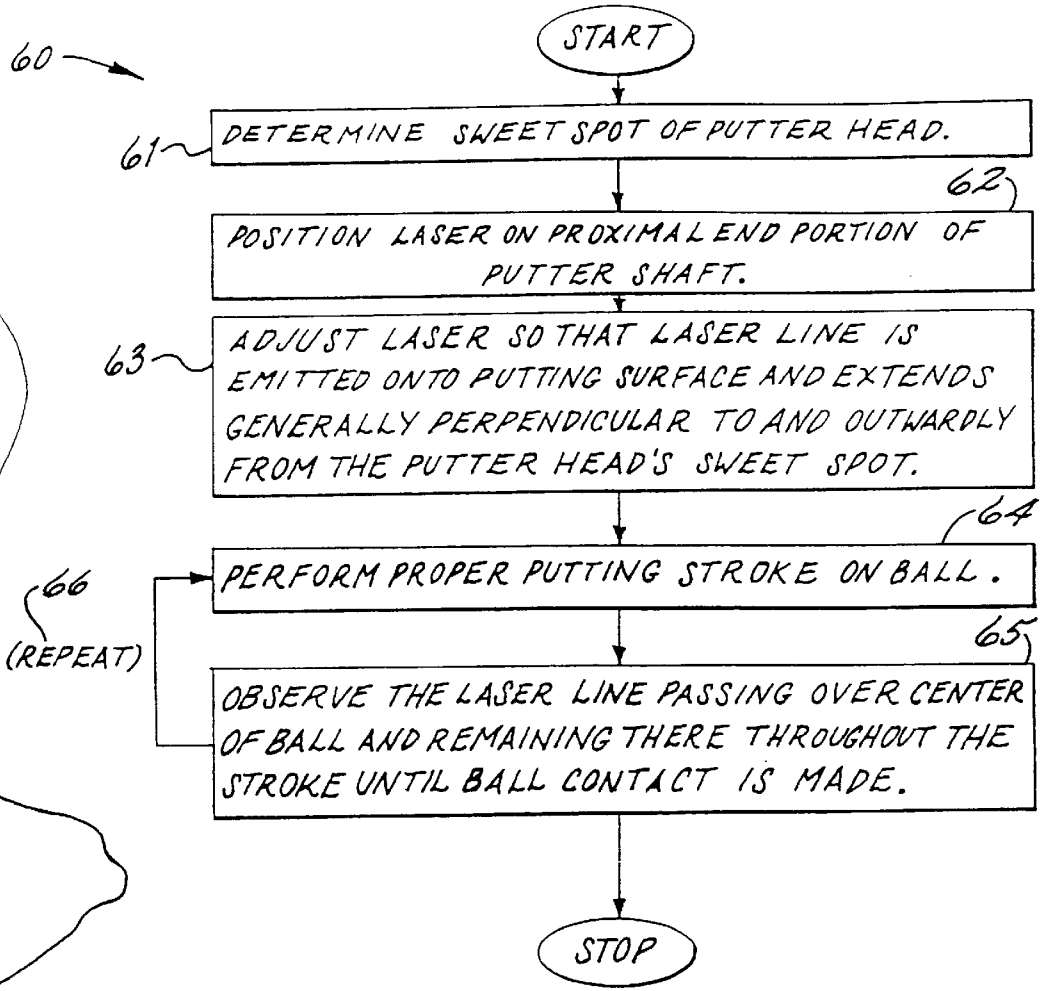
FIG. 4 is a schematic flow diagram of a method of training golf putting skills according to a second embodiment of the present invention.
Figure 6:
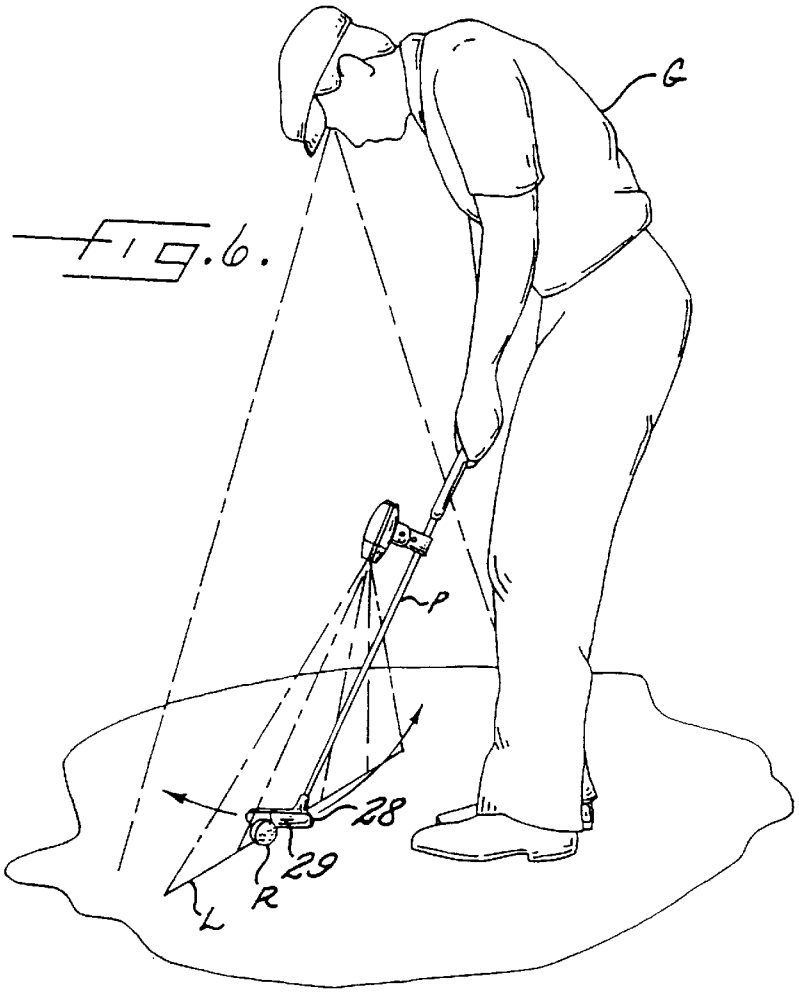
FIG. 6 is a perspective view of a golfer using an apparatus and a method according to a second embodiment of the present invention.
Figure 5:
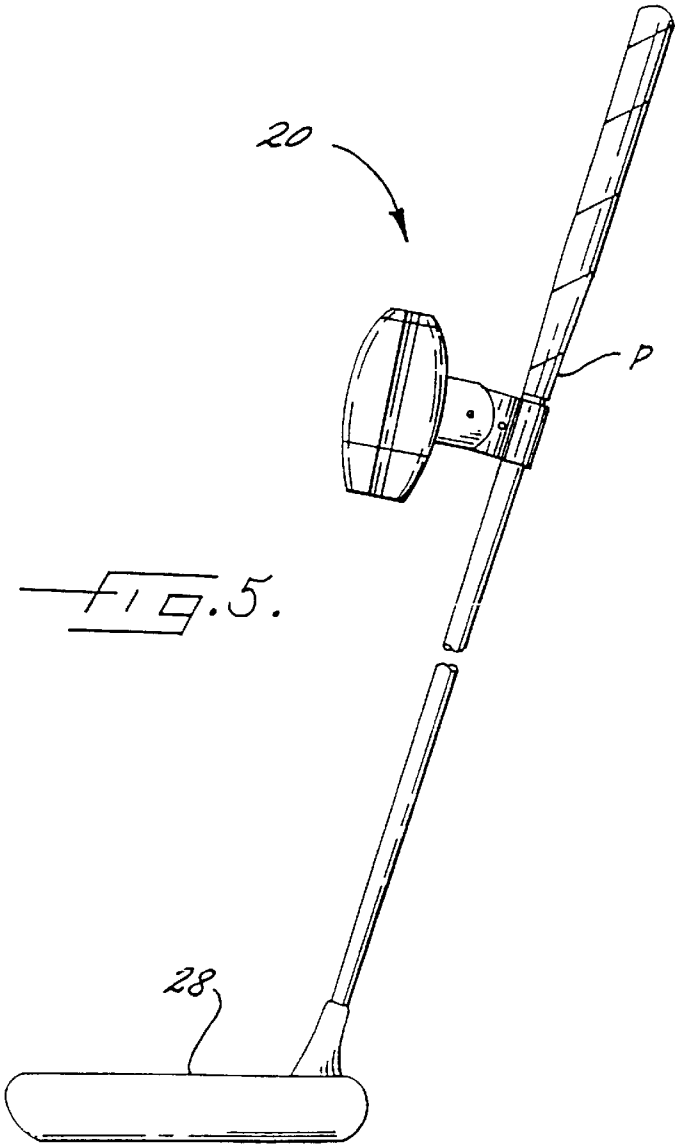
FIG. 5 is a side elevational view of an apparatus for training golf putting skills mounted on the shaft of a golf putting club according to the present invention.

FIGS. 4–6 illustrate a method 60 of training golf putting skills related to improving a sweet-spot type swing for a golfer G according to the present invention. The method preferably includes determining 61 a sweet spot 29 of the head of a golf putting club P, positioning 62 a light projecting apparatus 20 on a golf putting club, and projecting 63 a beam of light from the apparatus 20 onto a putting surface so as to form a line L positioned generally perpendicular to and outwardly from the sweet spot 29 of the head 28 of the golf putting club P. A golfer G then performs 64 a pendulum swing on either a real R or imaginary ball I and attempts 65 to maintain the line L of light so that it passes over the center of the ball and remains there throughout the stroke until ball contact is made.

The method 60 preferably also includes repeating 66 the steps of performing 64 a pendulum-type swing and attempting 65 to maintain the line L of light to thereby develop a proper and consistent sweet spot putting stroke. The visual image formed by the apparatus 20 assists the golfer G in remembering or visualizing the path of travel and the alignment of the sweet spot putting stroke. As understood by those skilled in the art, the step of performing 64 a pendulum-type swing preferably includes simultaneously pivoting both arms of a golfer G about the shoulders of the golfer G in a clockwise direction to a desired elevation upwardly away from the imaginary ball I and then simultaneously pivoting both arms of the golfer G in a counter clockwise direction downwardly toward the imaginary ball I. The step of positioning 61 a light projecting apparatus 20 preferably includes the apparatus 20 having a laser 26 positioned in a housing 21 and adapted to project light therefrom (see FIGS. 5 and 13–15).

Figure 9:
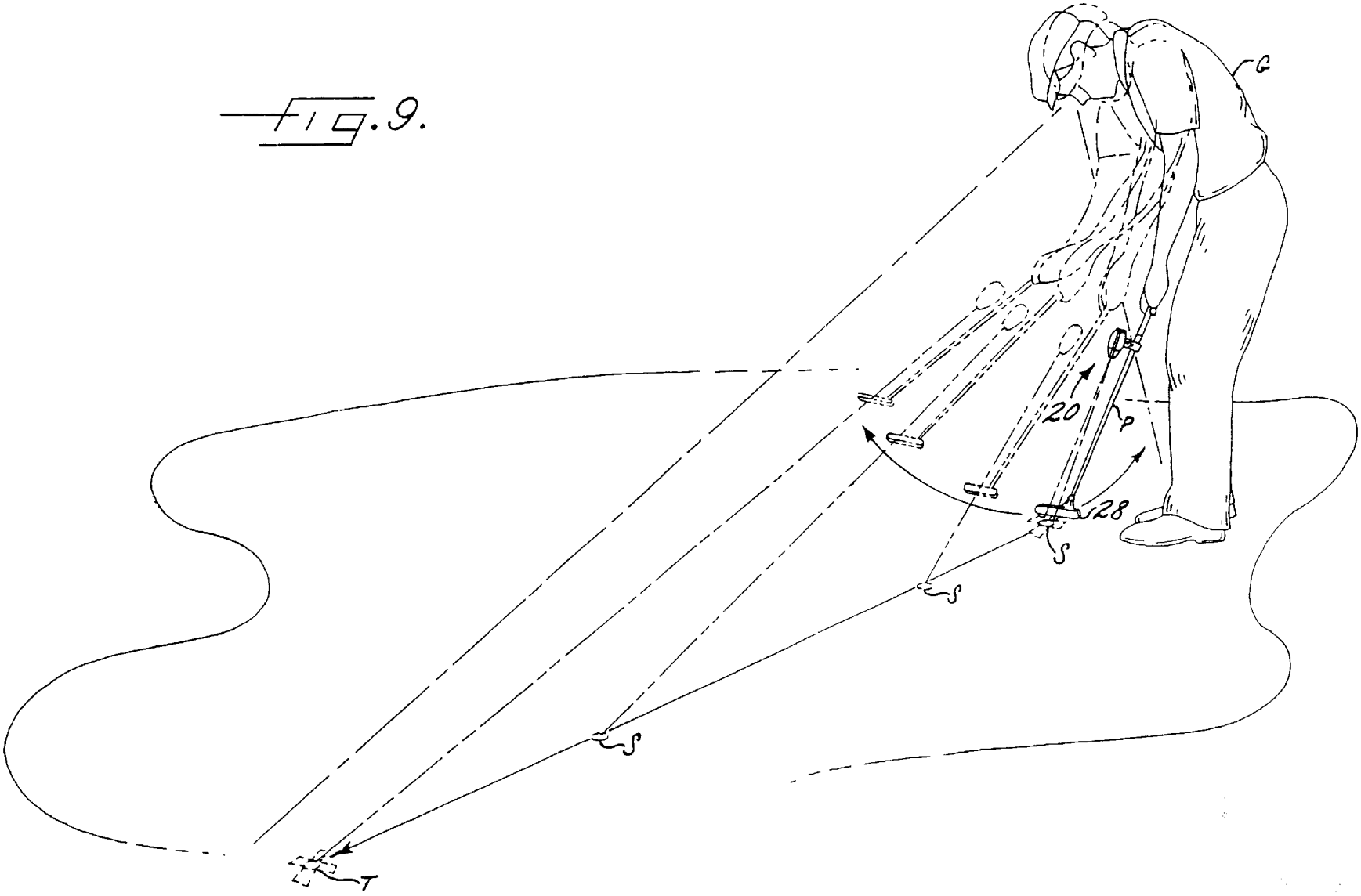
FIG. 9 is a perspective view of a golfer using an apparatus and a method according to a third embodiment of the present invention.

Additionally, FIGS. 7–9 illustrate a method 70 of training golf putting skills related to reducing pulling and pushing tendencies in a putting pendulum-type swing for a golfer G according to the present invention. The method preferably includes positioning 71 a light projecting apparatus 20 on a golf putting club P and projecting 72 a beam of light from the apparatus 20 onto a putting surface so as to form a spot S positioned adjacent a sweet spot of the head of the golf putting club P. Two imaginary points on the putting surface are selected 73 a predesired distance apart. A first imaginary point preferably represents an imaginary ball I and a second imaginary point preferably represents a target T. A golfer G then preferably performs 74 a pendulum swing on the imaginary ball I using the golf putting club P and follows through 75 the putting stroke until the projected spot S of light hits the target T so that the golfer G thereby attempts to draw a straight imaginary line from the ball I to the target T.

The method 70 preferably also includes repeating 76 the steps of performing 74 a pendulum-type swing and following through 75 the putting stroke to thereby reduce tendencies to push or pull the golf putting club P. The visual image and feel of the putting club P assist the golfer G in visually remembering what a proper stroke feels like so as to avoid pulling or pushing strokes. The predesired distance is preferably about 15 feet, but various other distances for accomplishing the training exercise can be used as well, e.g., 10 feet, 5 feet, 25 feet. As understood by those skilled in the art, the step of performing 74 a pendulum-type swing preferably includes simultaneously pivoting both arms of a golfer G about the shoulders of the golfer G in a clockwise direction to a desired elevation upwardly away from the imaginary ball I and then simultaneously pivoting both arms of the golfer G in a counter clockwise direction downwardly toward the imaginary ball I. The step of positioning 71 a light projecting apparatus 20 includes the apparatus 20 having a laser 26 positioned in a housing 21 and adapted to project light therefrom (see FIGS. 8 and 13–15).

Figures 10, 11:
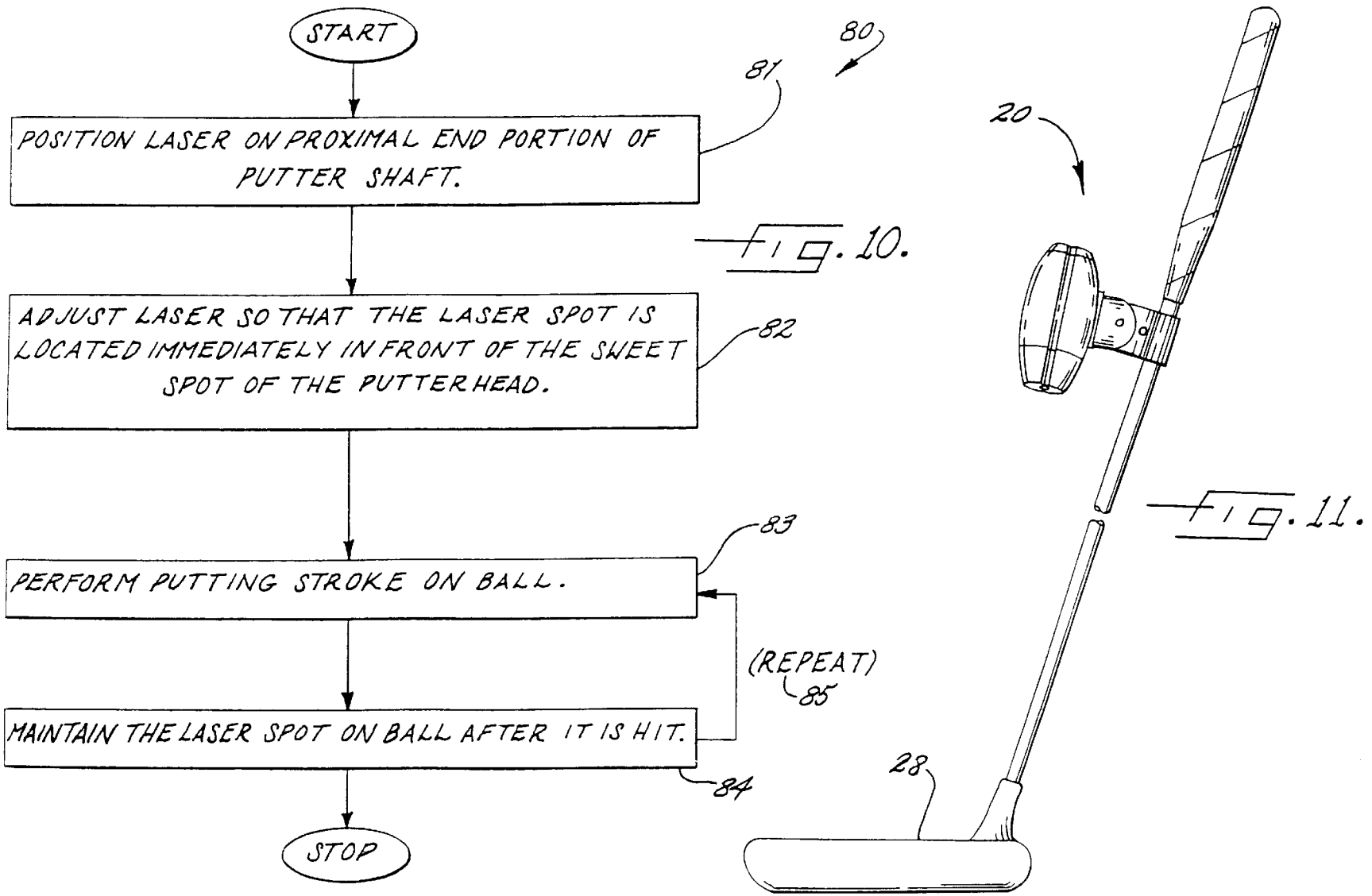
FIG. 10 is a schematic flow diagram of a method of training golf putting skills according to a fourth embodiment of the present invention.
FIG. 11 is a side elevational view of an apparatus for training golf putting skills mounted on the shaft of a golf putting club according to the present invention.
Figure 12:
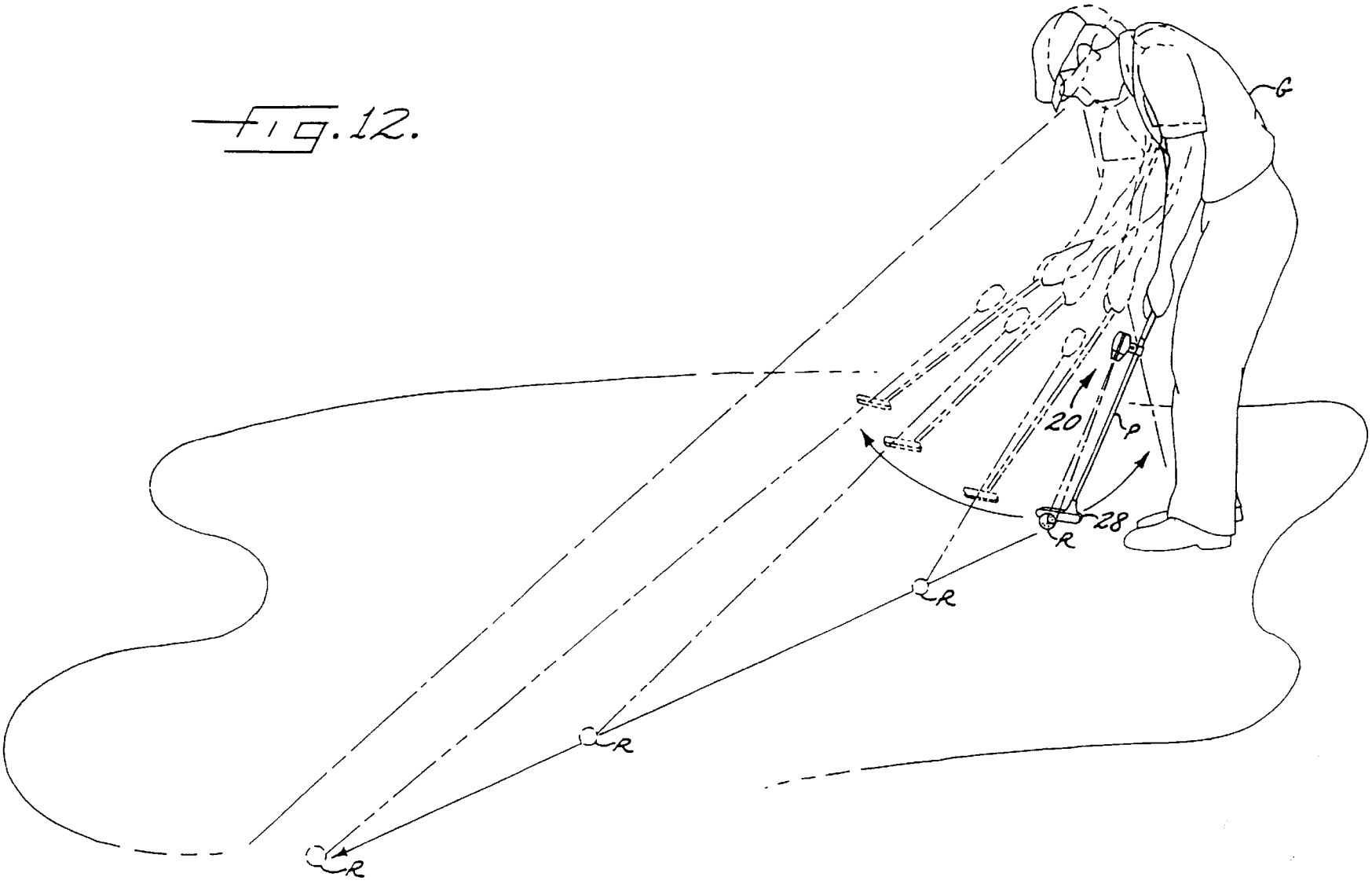
FIG. 12 is a perspective view of a golfer using an apparatus and a method according to a fourth embodiment of the present invention.
Figure 13:
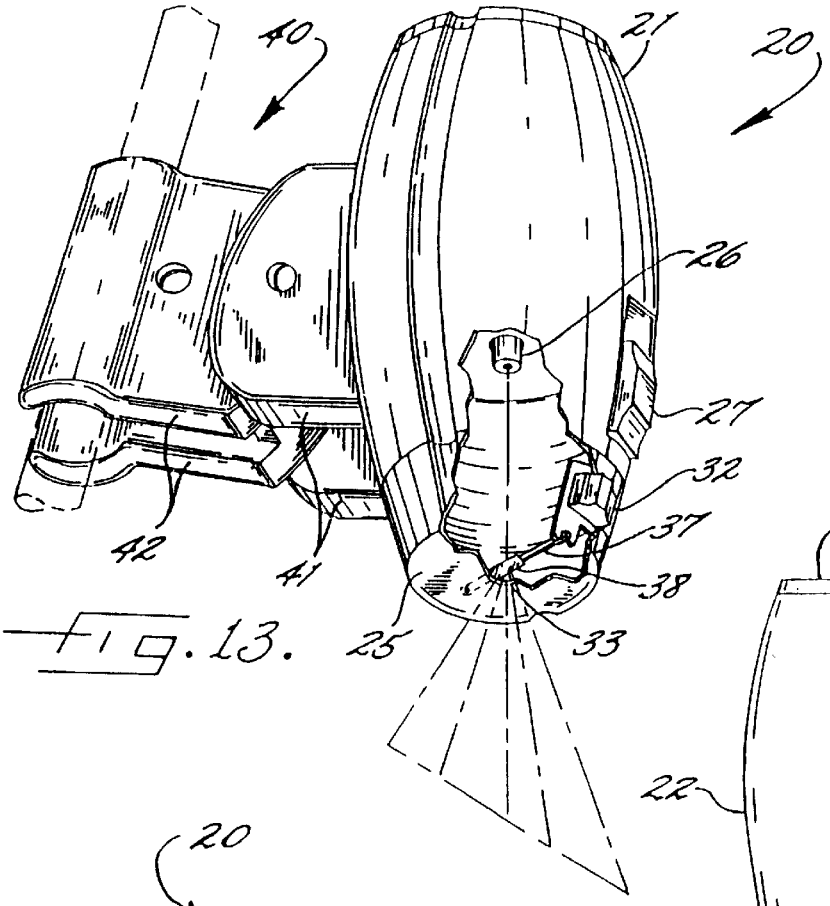
FIG. 13 is a perspective view of an apparatus for training golf putting skills mounted on the shaft of a golf putting club shown in phantom view and having portions thereof broken away for clarity according to the present invention.
Figure 14:
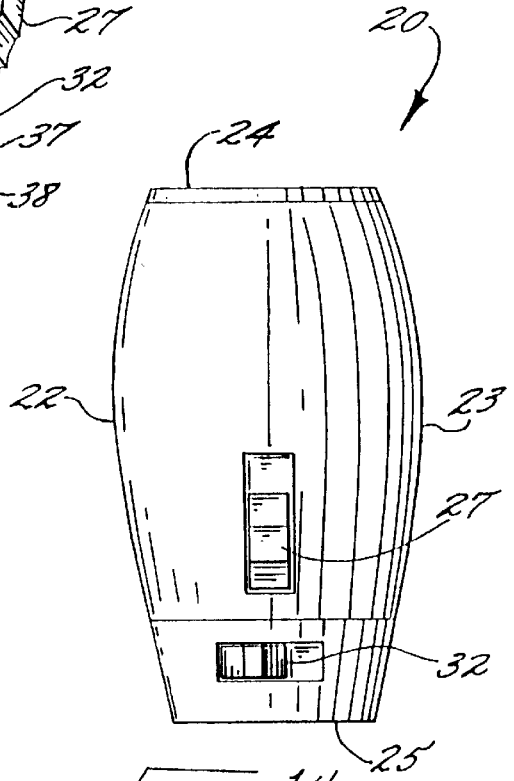
FIG. 14 is a top plan view of an apparatus for training golf putting skills according to the present invention.

FIGS. 10–12 illustrate a method 80 of training golf putting skills related to improving a follow-through in a putting pendulum-type swing for a golfer G according to the present invention. The method preferably includes positioning 81 a light projecting apparatus 20 on a proximal end portion of a golf putting club P and projecting 82 a beam of light from the apparatus 20 onto a putting surface so as to form a spot S positioned adjacent a sweet spot 29 of the head 28 of the golf putting club P. A golfer G then performs 83 a pendulum swing on a golf ball using the golf putting club P and attempts 84 to maintain the projected spot of light on the golf ball after striking the golf ball with the lead 28 of the golf putting club P until it reaches the target T.

The method 80 preferably also includes repeating 85 the steps of performing 83 a pendulum-type swing and attempting 84 to maintain the projected spot S of light on the golf ball R to thereby improve follow through of the pendulum-type swing. The visual image and the feel of the putting club P assist a golfer G in remembering the proper stroking techniques such as when used on a golf course during a competitive or sporting game. The predesired distance is preferably about 15 feet, but various other distances for accomplishing the training exercise can be used as well, e.g., 10 feet, 5 feet, 25 feet, according to the present invention. As understood by those skilled in the art, the step of performing 83 a pendulum-type swing preferably includes simultaneously pivoting both arms of a golfer G about the shoulders of the golfer G in a clockwise direction to a desired elevation upwardly away from the ball R and then simultaneously pivoting both arms of the golfer G in a counter clockwise direction downwardly toward the ball R. The step of positioning 81 a light projecting apparatus 20 preferably includes the apparatus 20 having a laser 26 positioned in a housing 21 and adapted to project light therefrom.

The present invention also preferably includes one or more combination of the methods 50, 60, 70, 80. A method of training golf putting skills according to an embodiment of such a combination preferably includes practicingly repeating a pendulum-type swing 56, using the practiced pendulum-type swing 50 for practicingly repeating a sweet-spot type swing 66, and using the practiced pendulum-type 50 and the practiced sweet-spot type swing 60 for practicingly repeating a follow through 85 during the practiced pendulum swing. The method can also include using the practiced pendulum-type swing 50 for practicingly repeating a putting stroke 76 so as to reduce tendencies to push or pull a golf putting club during the pendulum-type swing.

As best illustrated in FIGS. 2–3, 5–6, 8–9, and 11–15, the present invention also includes an apparatus 20 for training a plurality of golf putting skills and being adapted to connect to a shaft S of a golf putting club P. By the use of the apparatus 20 of the present invention, a golfer G can advantageously practice and train to have a more effective putting stroke by the use of the various methods of the invention as described above. The apparatus 20 allows a golfer 20 to practice all of these methods 50, 60, 70, 80 of the invention either in isolation, in combination, or in series so that one of the skills learned from one method and once mastered can assist in performing the other training skills, e.g., practicing a pendulum-type swing assists with practicing follow through or practicing to reduce tendencies to push or pull the golf putting club P.

The apparatus 20 preferably includes a housing 21 and an optical transmitter 26 positioned in the housing for transmitting light from a distal opening 33 in the front surface 25 of the housing 21. As perhaps best illustrated in FIG. 14, the housing 21 includes a pair of arcuate side peripheries 22, 23 and relatively flat proximal and distal end peripheries 24, 25. As illustrated, the housing 21 preferably has an oblong shape and preferably readily fits in the hand of and a pocket of a golfer G The optical transmitter 26 is preferably provided by a laser as understood by those skilled in the art. The laser 26 is preferably provided by a laser emitting diode connected to a power source, e.g., preferably a portable power source such as a battery. Power to the laser 26 is preferably initiated by a manual power switch 27 connected to the housing 21 adjacent a manual light configurating switch 32.

The apparatus 20 also preferably includes light pattern configurating means 30, e.g., preferably provided by a light pattern configurator, is associated with the housing 21 for selectively configuring the transmitted light into at least two light patterns, e.g., a line pattern of light or a spot pattern of light. The light pattern configurating means 30 includes a light configurating switch 32 connected to an upper surface of the housing 20 for switching between the at least two light patterns and at least one pattern generator 35 responsive to the light configurating switch and positioned for receiving the transmitted light from the optical transmitter for generating a selected light pattern. The pattern generator 35 is preferably a glass or plastic rod 38 that is switchingly positioned by a cam mechanism 37, as understood by those skilled in the art, connected to the switch 32 and to the rod 38 into the path of transmitted light. In other words, the laser 26 preferably emits a beam of light forming a spot S on the putting surface in a first position and when the glass rod 38 is switched into a second position to receive the beam of light, a line L of light is projected or emitted from the housing 21.

The apparatus 20 also preferably includes shaft mounting means 40, e.g., preferably provided by a shaft mounting device, connected to the housing 21 for adjustably and detachably connecting the housing 21 to the shaft S of a golf putting club P. The shaft mounting means 40 preferably includes a housing connector 41 connected to a lower surface of the housing 21 and a shaft connector 42 pivotally connected to the housing connector 41. The shaft mounting means 40 of the apparatus 20 advantageously provides the apparatus 20 with a plurality of mounting and aligning positions to more effectively train a golfer G on a variety of putting skills.

Figure 15:
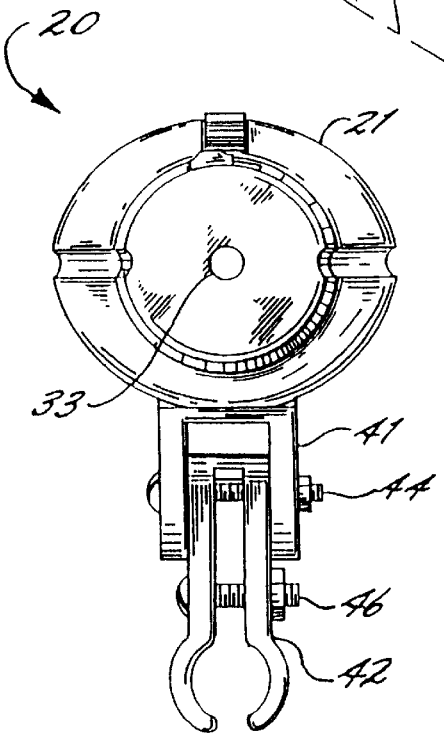
FIG. 15 is a front elevational view of an apparatus for training golf putting skills according to the present invention.

As perhaps best illustrated in FIG. 15, each of the housing and shaft connectors 41, 42 preferably are formed by a pair of generally parallel plate members. The housing connector plate members extend downwardly from and generally perpendicular to a lower surface of the housing 21. The shaft connector plate members pivot about a pivot rod 44 connected to the housing connector 41. An adjustable shaft fastener 46 is connected to the shaft connector 42 for adjustably tightening the shaft connector 42 onto the shaft of a golf putting club P.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. A method of training golf putting skills related to improving a sweet-spot type swing for a golfer, the method comprising the steps of:

determining a sweet spot of the head of a golf putting club;

positioning a light projecting apparatus on a proximal end portion of a golf putting club;

downwardly projecting a beam of light from the apparatus positioned on the proximal end portion of the golf putting club onto a putting surface so as to form a line of light on the putting surface, the line of light being positioned substantially perpendicular to and extending outwardly a substantial distance prior to and a substantial distance away from the sweet spot of the head of the golf putting club to thereby enhance the viewing of the line of light by the golfer and assist the golfer in remembering the alignment of the sweet spot of the head of the golf putting club;

performing a pendulum-type swing on either a real or an imaginary ball; and maintaining the line of light so that it passes over the center of the ball and remains there throughout the stroke until ball contact is made.

2. A method as defined in claim 1, further comprising repeating the steps of performing a pendulum-type swing and maintaining the line of light so that it passes over the center of the ball to thereby develop a proper and consistent sweet spot putting stroke.

3. A method as defined in claim 2, wherein the step of performing a pendulum-type swing includes simultaneously pivoting both arms of a golfer about the shoulders of the golfer in a clockwise direction to a desired elevation upwardly away from the imaginary ball and then simultaneously pivoting both arms of the golfer in a counter clockwise direction downwardly toward the imaginary ball.

4. A method as defined in claim 3, wherein the step of positioning a light projecting apparatus includes the apparatus having a laser positioned in a housing and adapted to project light therefrom.

* * * * *